US005848574A

United States Patent [19]

Lande

[11] Patent Number: 5,848,574

[45] Date of Patent: Dec. 15, 1998

[54] MULTI-HULL WATERCRAFT WITH SELF-RIGHTING CAPABILITIES

[76] Inventor: Arnold J. Lande, 3000 W. River Pkwy. #304, Minneapolis, Minn. 55406

[21] Appl. No.: 799,302

[22] Filed: Feb. 13, 1997

Related U.S. Application Data

[60] Provisional application No. 60/011,675 Feb. 14, 1996.

[51] Int. Cl.[6] ..... B63B 1/14

[52] U.S. Cl. ..... 114/39.1; 114/61; 114/91; 114/123

[58] Field of Search ..... 114/39.1, 61, 91, 114/123; 441/38

[56] References Cited

U.S. PATENT DOCUMENTS

| | | | |
|---|---|---|---|
| 3,141,435 | 7/1964 | Moffitt, Jr. | 114/39.1 |
| 3,604,382 | 9/1971 | Sorrenti | 114/61 |
| 3,656,445 | 4/1972 | Padwick | 114/39.1 |
| 4,102,287 | 7/1978 | Ferris . | |
| 4,392,444 | 7/1983 | Andersson | 114/39.1 |
| 4,457,248 | 7/1984 | Thurston | 114/39.1 |
| 5,277,142 | 1/1994 | Connor | 114/61 |

FOREIGN PATENT DOCUMENTS

| | | | |
|---|---|---|---|
| 274232 | 7/1988 | European Pat. Off. | 114/91 |
| 2551420 | 3/1985 | France | 114/61 |
| 2618749 | 2/1989 | France | 114/61 |
| 839716 | 6/1960 | United Kingdom | 441/38 |
| 87/07228 | 12/1987 | WIPO | 114/61 |

OTHER PUBLICATIONS

Book: "The Capsize Bugaboo" published by Chiodi Advertising & Publishing, Inc., Boston, MA © 1980.

Amateur Yacht Research Society, Publication No. 63, "Multihull Capsizing", Jan. 1968.

*Primary Examiner*—Sherman Basinger

*Attorney, Agent, or Firm*—Haugen and Nikolai, P.A.

[57] ABSTRACT

A multi-hull watercraft, such as a catamaran or trimaran is constructed to facilitate the righting thereof following a capsize. By providing a pivot connection between the hulls and the cross-members, in accordance with one method, it is possible to right the capsized vehicle by piecemeal rotation of the hulls through 180° from an inverted to an upright disposition. Following this maneuver, the mast may be either rotated up and out of the water to an erect disposition or, alternatively, the mast can be jacked vertically through the deck. In accordance with a second method, the multiple hulls are interconnected by articulated, extendable and contractible cross-members and righting is achieved by sequentially reducing the beam of the craft, canting its buoyant mast from vertical so that the watercraft will roll so as to be floating on one hull and on the buoyant mast and then while canting the mast in the opposite direction again extending the cross-member to increase the beam such that a rotational moment about the one hull is created sufficient to raise the mast out of the water to an upright disposition.

23 Claims, 23 Drawing Sheets

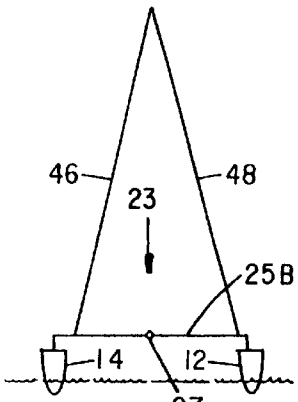
FIG. 18A
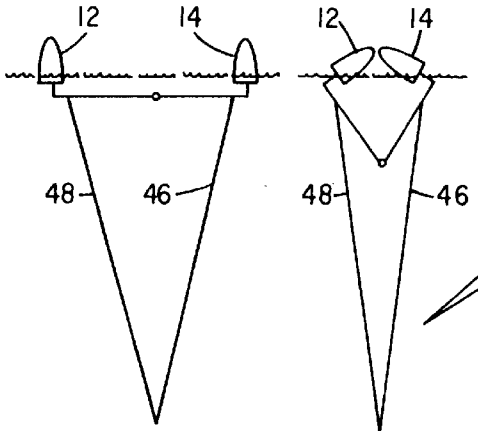
FIG. 18B
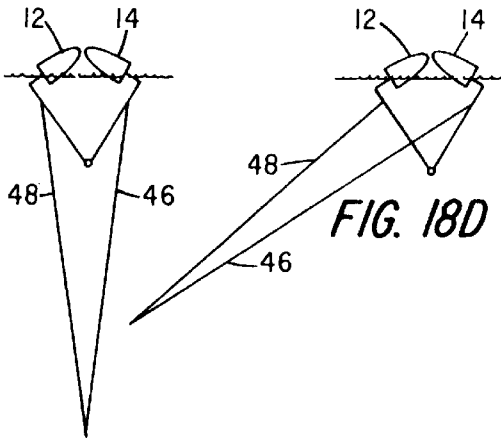
FIG. 18C
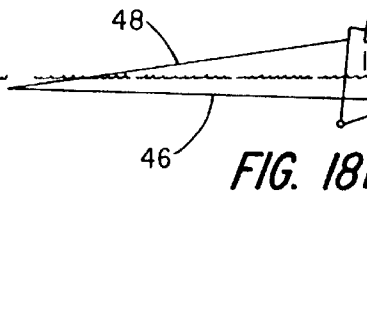
FIG. 18D
FIG. 18E
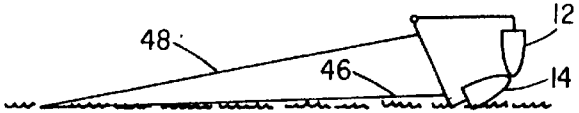
FIG. 18F
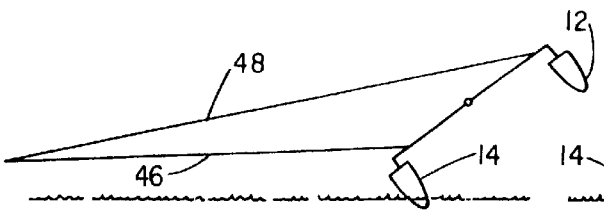
FIG. 18G
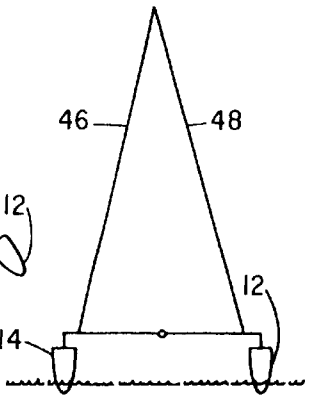
FIG. 18H

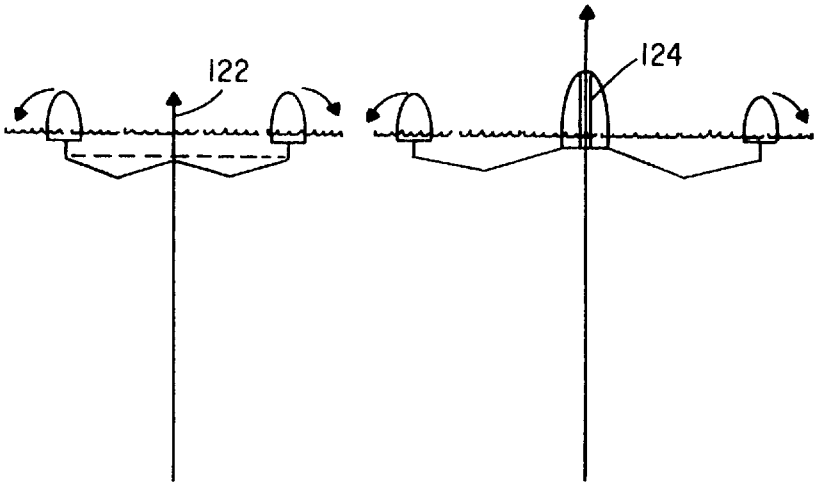
FIG. 25
FIG. 26
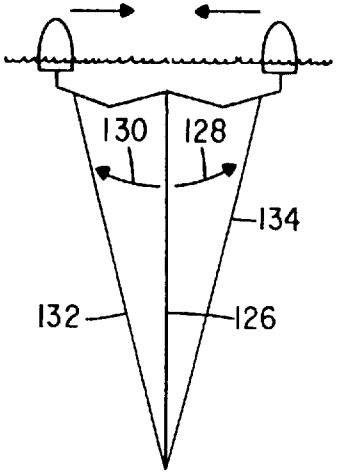
FIG. 27
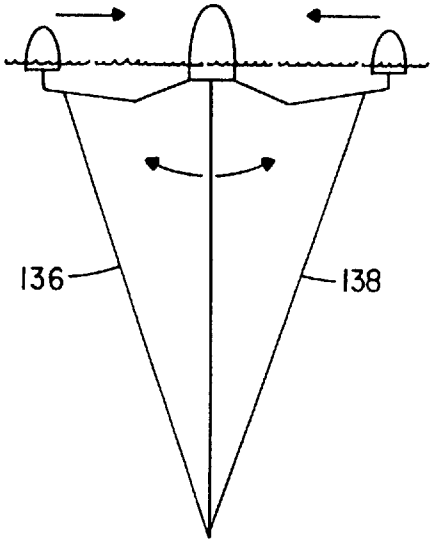
FIG. 28

MULTI-HULL WATERCRAFT WITH SELF-RIGHTING CAPABILITIES

BACKGROUND OF THE INVENTION

CROSS REFERENCE TO RELATED APPLICATION

This application claims the benefit of U.S. Provisional Application No. 60/011,675, filed Feb. 14, 1996.

Field of the Invention

This invention relates generally to multi-hull watercraft including sailboats and powerboats, and more particularly to a multi-hull watercraft incorporating mechanisms for the piecemeal or articulated righting of such a watercraft when capsized.

Discussion of the Prior Art

Multi-hull sailboats are, perhaps, the most rapidly growing segment of the sailboat industry. Their popularity results most basically from their inherent stability, which, in turn, derives specifically from their wide beams as compared to monohulls. Wide beam stability can also result in a higher rate of speed, since it permits narrow, low resistance waterlines and increased sail-carrying capacity. Popularity has also increased since the America's Cup Race in 1988 was won by a catamaran, Stars & Stripes.

Catamaran is the name applied to a craft having twin hulls. In it, two similar or identical hulls are joined parallel to each other at some distance apart by cross-beams or a platform. This type of sailboat has the advantage of increased stability that can be combined with lightness and low water resistance and large sail carrying capacity.

Another multi-hull watercraft powered by engine or sail is the trimaran which has three separate hulls. At present, because of shorter length of the individual connecting cross-beams, trimarans can be built with even wider overall beams than catamarans. This, and the ability to attach the jib firmly to the main hull, results in the greatest stability and speed up wind. Also, trimarans, with practical systems for narrowing their beams for berthing and trailering, are being marketed today. However, larger catamarans provide more living space than equivalent-length trimarans and they may have some advantage down wind. While sailing multi-hulls have predominated in their development, motorized catamarans are also being explored for their stability, speed and useful space.

Ironically, perhaps the greatest limitations on multi-hull sailcraft also derive from their stability and wide beam. Finding an adequate berth or slip is difficult and expensive. Only the smallest multi-hulls can be trailered while assembled, and only a few which are slightly larger, can be collapsed efficiently to comply with road restrictions. Possible increased stresses on cross-beams, hulls and trimaran amas also make wide beams difficult. Hence, sail areas, aspect ratios and speeds are restrained by beam widths which must be realistic.

Another factor limiting multi-hulls today is the difficulty in righting any but the smallest of such craft without assistance after capsizing. That is to say, while wider beams tend to protect from capsizing, they also compound the problem of righting the craft after capsize. Multi-hulls, unlike ballasted mono-hulls, have their greatest stability when vertical, and when capsized. The difficulty of recovering from a capsize remains a problem of multi-hulls in the eyes of many.

Prior art approaches at solving the capsize problem have been mostly limited to providing masthead floats which attempt to prevent a partial capsize from becoming complete. Reference is hereby made to a book entitled "The Capsize Bugaboo" published by Chiodi Advertising & Publishing, Inc. of Boston, Mass., Copyright 1980. This book is a compendium of approaches for both preventing capsize of multi-hull craft and prior art attempts at achieving self-righting thereof. None of the disclosed self-righting approaches teaches or suggests the methods described and claimed herein.

Articulated trimarans are currently available which can be narrowed to fit into a slip or onto a trailer, and some catamarans can be narrowed for trailering, but systems for righting completely capsized multi-hulls are essentially non-existent. Most prior proposals for capsize recovery involved controlled flooding of hulls or parts of hulls and amas along with accompanying compromises in flotation to make this possible, and none have ever been implemented in an emergency situation. Motorized multi-hulls are limited by the same problems of breadth of beam.

Accordingly, when considering relatively large size multi-hull sailing craft of lengths ranging from, say, 25 feet to 250 feet, and whose beams approach their lengths and having masts whose height are approximately 1 to 2 times their lengths, a need exists for a way to recover from a capsize. Moreover, a need exists for a multi-hull sailing craft that allows for a narrowing of the beam to facilitate berthing and/or trailering.

SUMMARY OF THE INVENTION

In accordance with the present invention, a multi-hull craft is constructed to facilitate "piecemeal righting" of each hull of a capsized catamaran and of the hull and amas of a capsized trimaran. By providing mechanically or hydraulically-actuated, hinged linkages for the outward and downward rotation of each capsized catamaran hull, and each trimaran ama parallel to its own longitudinal axis, and between terminal fore and aft cross-beams of the trimaran hull, piecemeal recovery from a capsized state is achieved. Piecemeal repositioning of a single inverted mast or an inverted bipod mast can be through rotation up between the twin bows or, in the case of a single mast, by jacking it up end-for-end through the mast step.

In accordance with another aspect of the invention, by providing articulated cross-members between the hulls of a catamaran or trimaran, a capsized watercraft can be righted in a way analogous to the manner in which a person would roll over in bed from, say, a spread eagled, supine position to a prone position. Specifically, the person first brings the arms and legs toward the midline with elbows directed into the mattress and with forearms and knees directed upward. This creates an imbalance and the subject may fall unto either side. Next, a shoulder shift adjusts the body even more toward the prone position. The upper arm is then extended out to create a longer lever pulling downward and the lower arm is extracted from underneath, completing movement to the spread eagled, prone position. Applying that analogy to the present invention, by providing articulated cross-members with the ability to extend and retract under control of a suitable hydraulic or other power mechanism, both of the hulls or amas may be drawn toward the center line of the boat allowing flotation forces on the buoyant center pod and on a buoyant mast to raise the capsized craft so that it is resting on only one hull or ama and with the lower portion of the bipod mast or the tip of the single mast lying extended along the surface of the water. As necessary, the buoyant mast can be canted to one side to assure there is a sufficient upward force vector to accomplish this step. The multi-hull craft is now in a narrowed, partially capsized state and is less likely to revert to a complete capsize because its beam has already been significantly narrowed and any capsizing moment will be significantly less. Corresponding to the shoulder shift of the person turning over in bed, the half-capsized, already narrowed multi-hull, constructed in accordance with the present invention, has the length of its upper bipod mast leg telescopicly extended by cables or otherwise to permit the hulls and amas to rotate further toward the upright, while the lower bipod mast remains floating parallel to the surface of the water. Alternatively, a single mast may be canted to one side by lengthening one side stay and shortening the other. Now, extending the retracted upper articulations of the cross-beams along with further extension or canting of the appropriate mast, similar to the person extending his upper arm in order to utilize gravity to pull himself even further toward the prone, will similarly increase the righting lever arm moment of the trimaran or catamaran, which may prove sufficient to cause rotation clear over the still retracted lower hull. At this point, the multi-hull of the present invention can extend the lower portions of its articulated cross-beams and lower hull, and thereby arrive at a righting lever arm equal to the total precapsize beam. Given the weight of the extended hull or ama, pod or center hull and cross-members, this moment is more than sufficient to overcome even the opposing weight of the bipod mast, which typically would be 1 to 2 times as long as the beam of the craft.

Thereafter, with the hulls and cross-members in upright position providing a stable platform, the extended upper side of the bipod mast can be shortened to its normal length, identical to its other side, bringing the bipod mast to its fully erect and centered position. Similarly, the single mast could be winched back to the midline.

The same articulated cross-beam structure is also used for narrowing and widening the vessel, such as may be needed for trailering or for allowing the craft to be berthed in a slip of smaller width than is required for conventional multi-hull watercraft. In some configurations, it may also be used for canting the hulls and for raising and lowering the center pod or cabin of a catamaran.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which:

FIGS. 18A through 18H are schematic drawings showing the method of self-righting a capsized catamaran of a simple configuration using the articulated approach;

FIGS. 25 and 26 schematically illustrate techniques for redeployment of a single mast on a multi-hull craft accompanying piecemeal righting of the hulls; and FIGS. 27 and 28 schematically illustrate a technique for canting and recentering a single mast on a multi-hull watercraft during articulated righting thereof.

DESCRIPTION OF THE PREFERRED EMBODIMENT

As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrate structure as the particular drawing figure faces the reader. Similarly, the terms "inwardly" and "outwardly" generally refer to the orientation of a surface relative to its axis of elongation, or axis of rotation, as appropriate.

Figure 1:
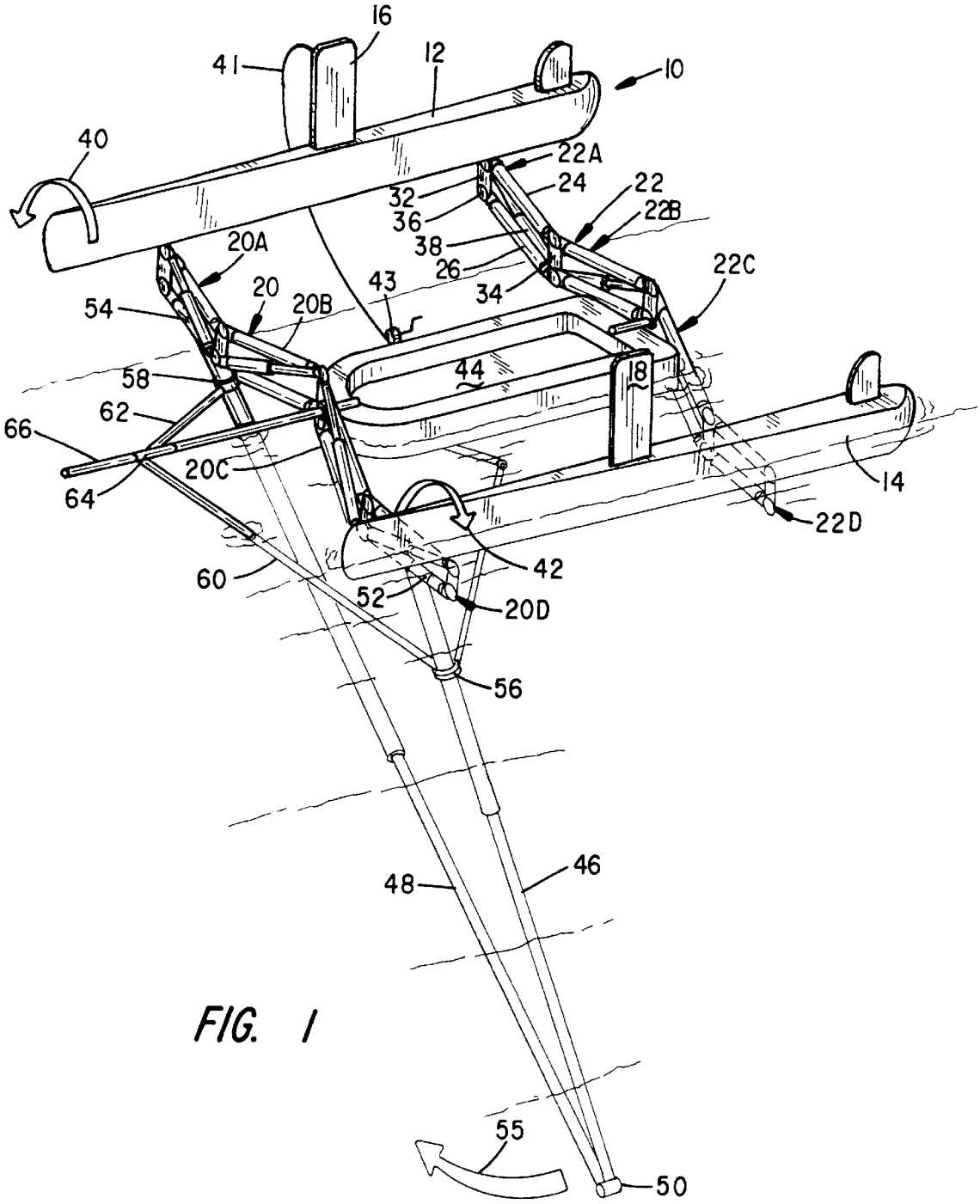
FIG. 1 illustrates a catamaran constructed in accordance with the present invention and in a capsized state prior to the self-righting thereof using a piecemeal approach.

Referring to FIG. 1, there is indicated generally by numeral 10 a multi-hull vessel, here shown as a catamaran 10, in a capsized state. As such, the port hull member 12 and the starboard hull member 14 are inverted from their normal sailing orientation such that the center boards 16 and 18 are directed upwardly. Extending between the hulls 12 and 14 proximate the bow and stern thereof are crossbeams, indicated generally by numerals 20 and 22, respectively. Each of the cross-beams comprises a plurality of four-bar linkage assemblies identified as 20*a*–20*d* and 22*a*–22*d* and which are shown in greater detail in FIGS. 2–4 and 14–16. Considering first the four-bar linkage assembly 22*a*, it is seen to comprise upper and lower arms 24 and 26. The members 24 and 26 are pivotally connected at opposed ends thereof to plate members 32 and 34 by means of suitable hinge pins, as at 36. Extending diagonally from hinge pin to hinge pin of the four-bar linkage is a hydraulic cylinder 38 which permits modification of the angularity of each of the four-bar linkage assemblies. This permits the beam of the craft to be varied. Each of the four-bar linkage assemblies 20*a*–20*d* and 22*a*–22*d* are substantially identical to the four-bar linkage 22*a*, the construction of which has been described in detail.

Figure 2:
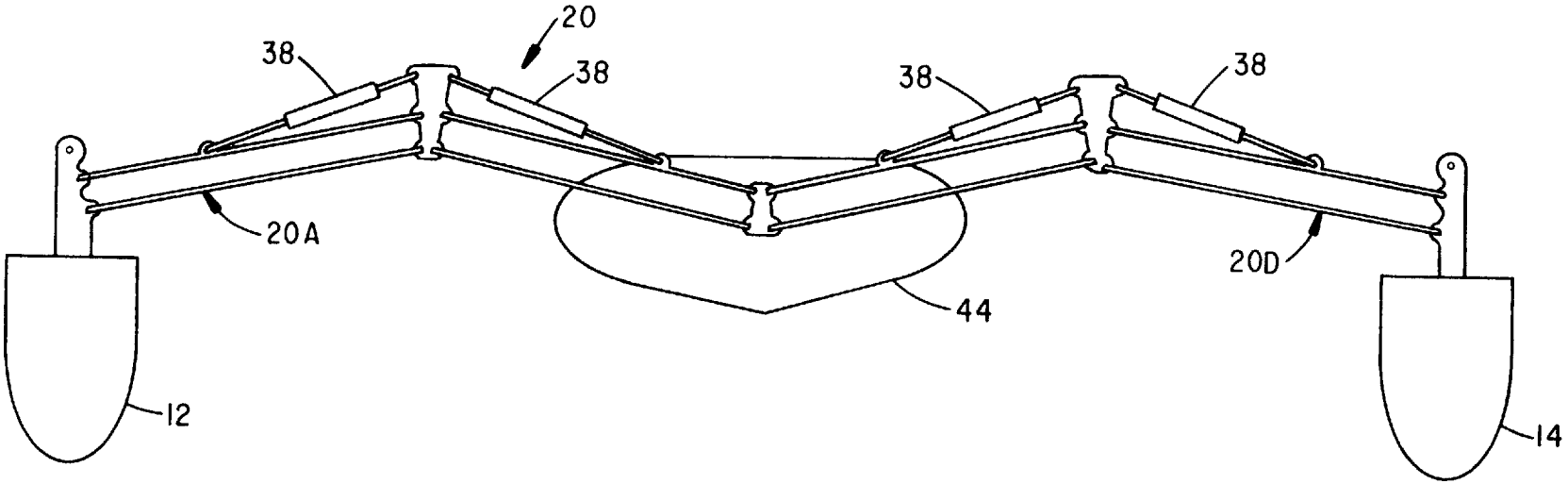
FIG. 2 is a front view of a complex articulated catamaran with its fore cross-beam extended and without masts or riggings, but including a centerpod or cabin.
Figure 3:
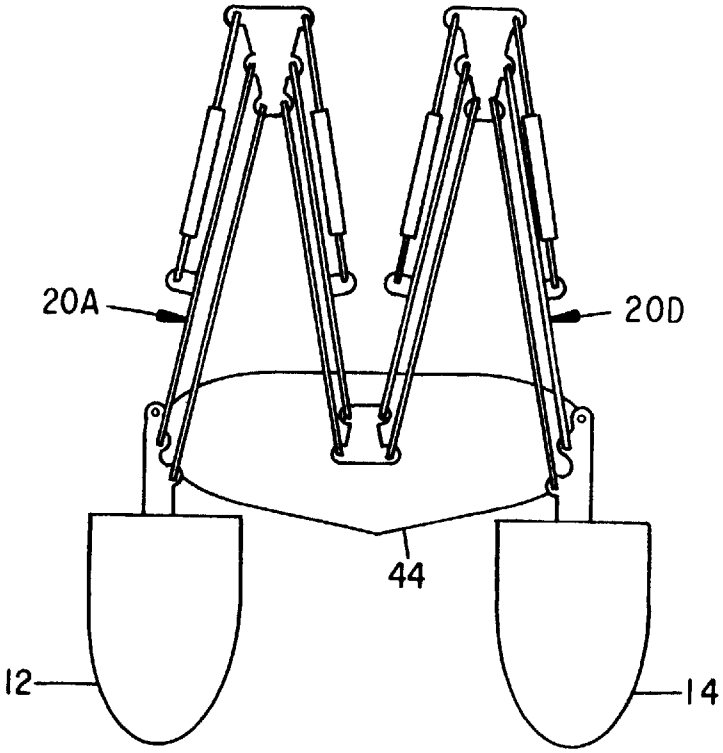
FIG. 3 is a front view of a complex catamaran with its fore cross-beam narrowed or retracted for berthing and without masts or rigging.

The cross-beams 20 and 22 are designed to contract from as wide a beam as the length of the hulls to as narrow a beam as the width of the two hulls nested side-by-side for trailering over the road. An "M" or "W" configuration with four principal segments, as illustrated in greater detail in FIGS. 2 and 3 is believed to be sufficient and the individual segments of the cross-beams constitute parallelograms which are arranged generally linearly and which share their end pieces and, thus, interact, side by side, with the end pieces remaining nearly parallel to each other in all configurations. Linear hydraulic cylinders, as at 38, have proven expedient to power and maintain the individual parallelograms and overall cross-beam configurations. They may also function as resilient shock absorbers to minimize impact forces. Those skilled in the art will appreciate, however, that four-bar linkage arrangements with linear hydraulics, such as those illustrated, are not the only way of achieving the necessary load bearing strength and adjustability. For example, manual and winch powering as well as rotational hydraulics and a variety of locking mechanisms may be used with or without parallelograms.

Figure 4C:
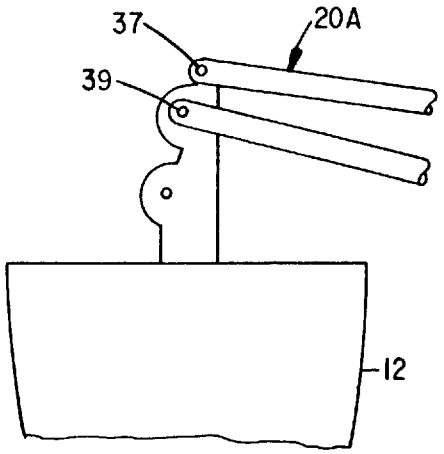
FIGS. 4A through 4C illustrate the steps involved in inverting the hulls of a complex catamaran when self-righting using the piecemeal approach.
Figure 4B:
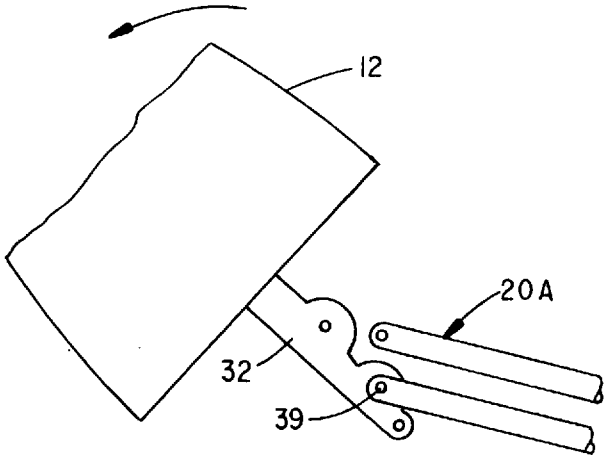
Figure 4A:
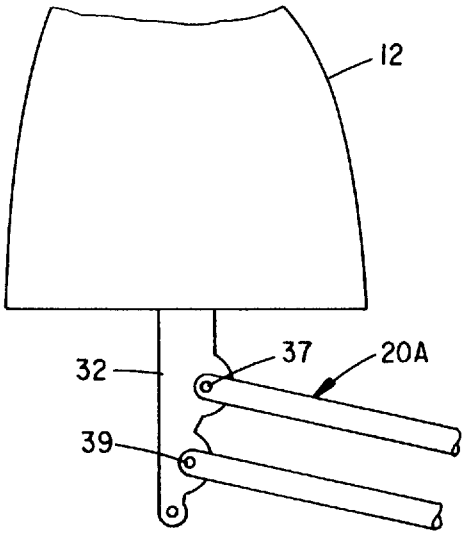

The hulls 12 and 14 are joined to the outermost end pieces of the cross-beams 20 and 22 by means of removable pins as at 37 and 39 in FIG. 4A, allowing piecemeal rotation of the hulls outwardly around the longitudinal axis of-the hulls as indicated by the arrows 40 and 42 in FIG. 1 and further illustrated in FIGS. 4B and 4C. This may be performed manually or with the aid of a pair of winches (one being shown at 43) affixed to a pod or cabin 44 and having lines, as at 41, attached to the respective center boards 16 and 18 of the hulls.

With reference to FIG. 1, articulated cross-members 20 and 22 further provide a support for a pod or cabin 44 suspended on bearings (not shown). The center pod or cabin 44 is light of structure and effective for flotation. It is suspended in the midline of the vessel from the opposed cross-beams so that when in its normal righted sailing condition, the pod rides above the waterline. When capsized, it, along with the lower hull, supports the capsized catamaran. The center pod 44, being pivotally suspended between the fore cross-beam 20 and the aft crossbeam 22 permits it to be rotated about its own longitudinal axis for reasons which will become clear as the description of the preferred embodiment progresses.

Figure 5:
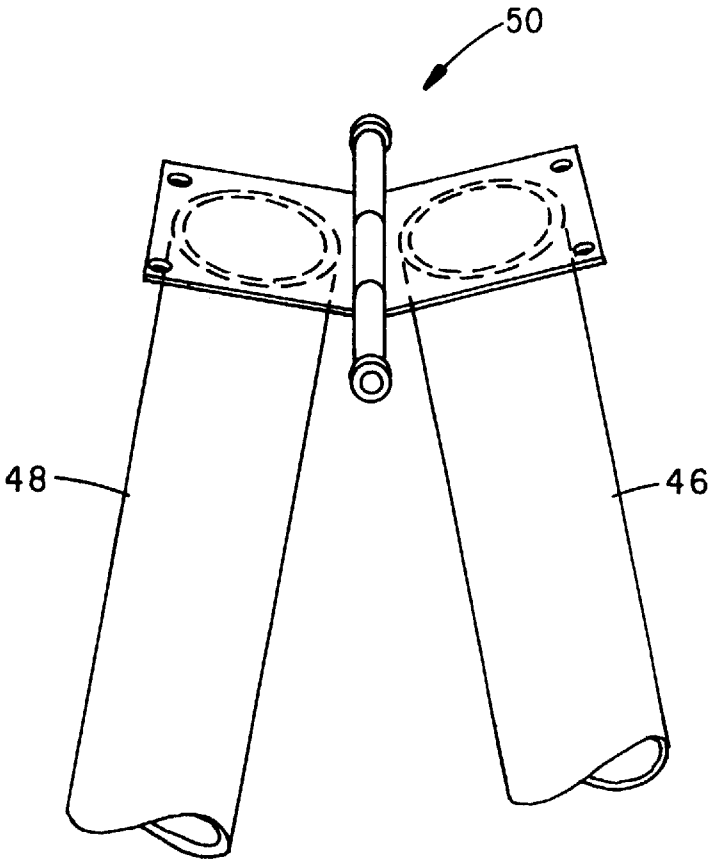
FIG. 5 is a view of the peak portion of a bipod mast used with the multi-hull craft of the present invention.

The fore cross-beam 20 also serves as a support for the mast or a wing sail or an aerorig of the catamaran 10. The mast, which in FIG. 1 is shown as being substantially totally submerged, is seen to comprise a bipod structure that includes first and second telescoping cylindrical tubular structures 46 and 48. As shown in FIG. 5, they are hinged together at the peak 50 of the masts and the extended segments are sealed to prevent water from filling the hollow interior and at their lower end the extending segments are joined to the cross bar members 26 of the four bar linkages 20*a* and 20*d* by universal joints 52 and 54. While illustrated as cylindrical, the masts can have air foils for streamlining.

Figure 6:
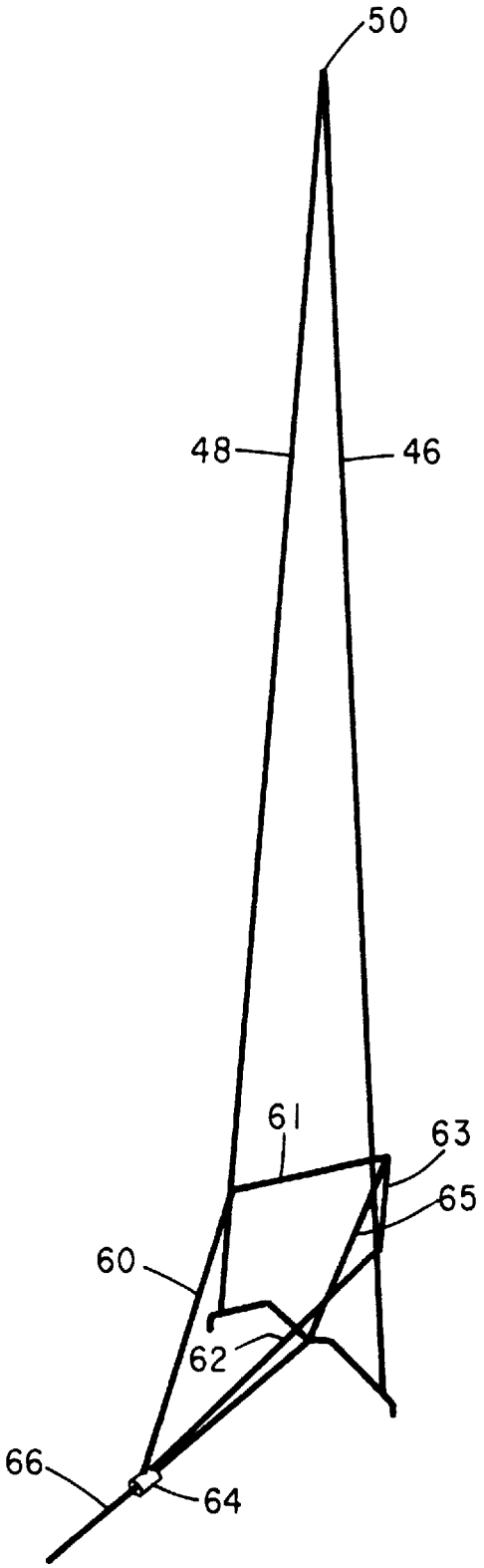
FIG. 6 is a schematic drawing of a bipod mast structure mounted on a complex articulated cross-beam with a Genaker pole and main tack support pole and associated forestruts and aftstruts.
Figure 7:
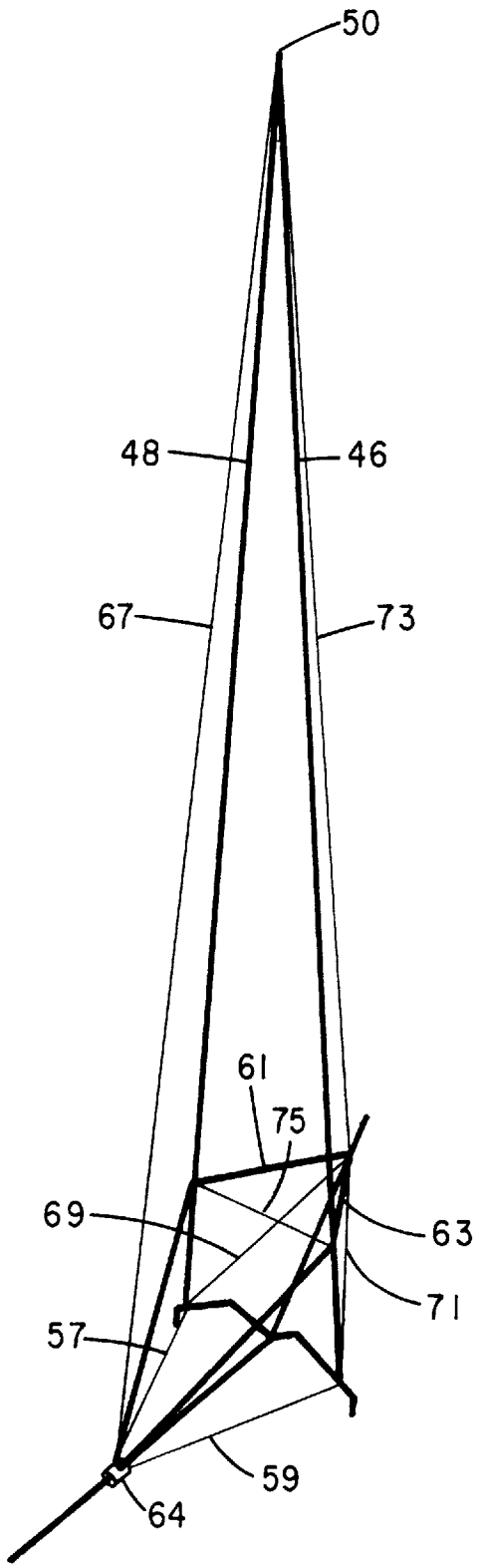
FIG. 7 is a view like that of FIG. 6, but with jibstay, mainsail luff line, guys and crosswire in place for providing rigidity to the mast structure.

With reference to FIG. 6 (and also visible in FIG. 1), projecting forward from the bipod mast segments 46 and 48 are twin forestruts 60 and 62 which meet and are joined to a jib tack fitting 64 slidingly disposed on a Genaker pole 66 which originates at approximately the middle of the forward cross-member 20. The jib tack fitting 64, which is supported by two or three poles and two wire guys 57 and 59 which are not shown in FIG. 1 or 6 but which appear in FIG. 7, thus, can act as a very solid anchor for a jibstay 67 while not interfering with beam narrowing or with piecemeal mast rotation up from the inverted capsized position or for trailering. The single jibstay is connected to the peak of the masts 46 and 48. Also visible in FIGS. 6 and 7 are aftstruts 61 and 63 which join together at a main tack fitting 65A slidably mounted on a main tack support pole 65A. Again, suitably arranged aft guys 69 and 71 provide rigidity to the main tack fitting 65, allowing it to serve as an anchor for the mainsail luff line 73 and the boom. To prevent the masts from bowing outward due to the stress imposed by the fore struts and the aft struts, a cross wire 75 extends between the two halves of the bipod mast to provide an opposing inward force on the masts. The cross wires 75 insure rigidity of the mast structure when the cross-beams are fully extended in their sailing position with the jibstay 67 and luff line 73 tensioned. The triangular arrangements of the guys, jibstay, mainsail luff line and struts result in a very stiff and rigid mast structure and associated fore stays and aft stays.

Figure 8:
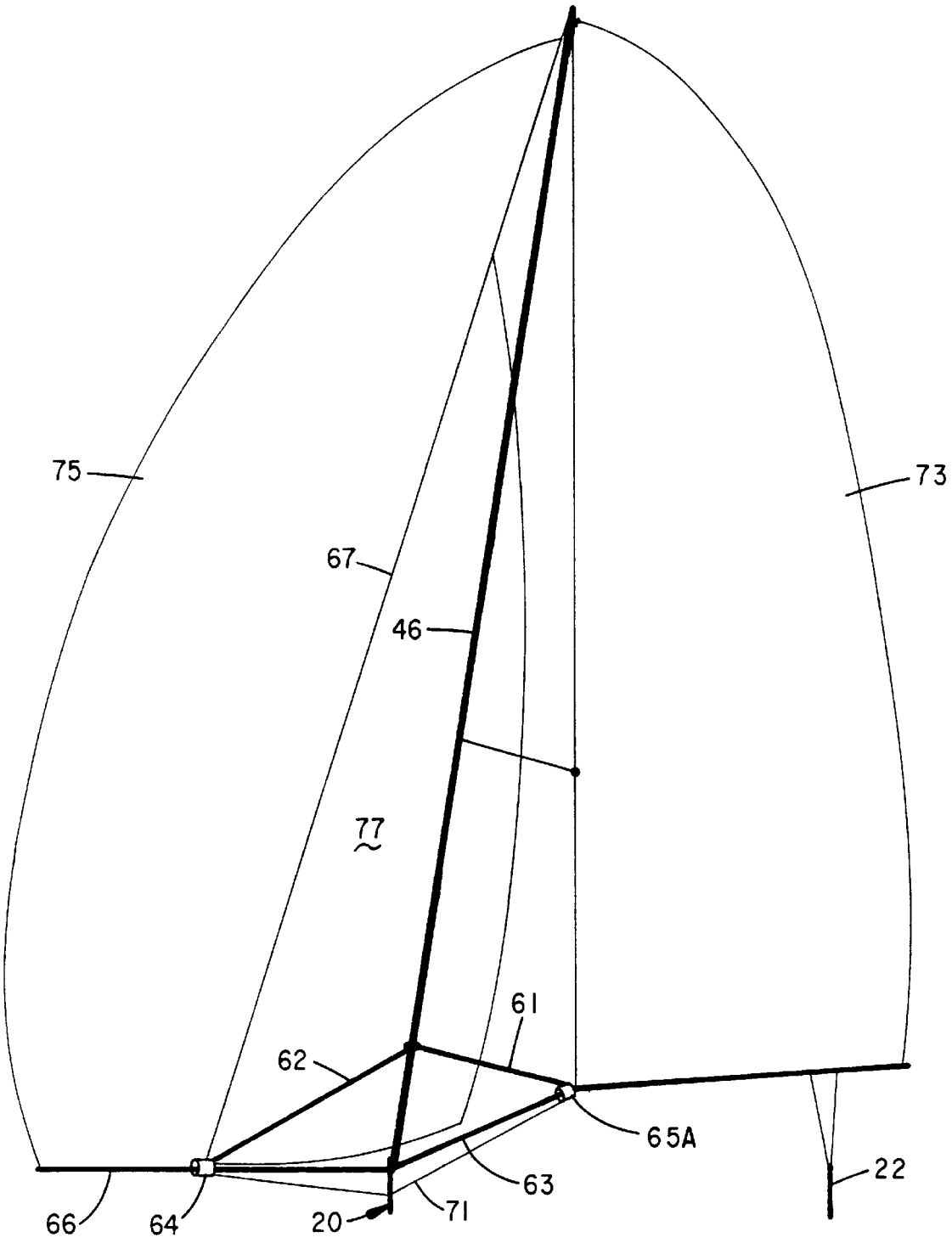
FIG. 8 is a side view that illustrates the bipod mast structure and sails.

FIG. 8 is a side elevation in which the fore cross-beam 20 and aft cross-beam 22 are shown, but without the hull member 14 affixed to these cross-beams. The main sail 73 and a Genaker 75 are disposed on the mast 46 as is the jib 77.

Having generally described the constructional features of the catamaran constructed in accordance with the present invention, consideration will next be given to its mode of operation.

OPERATION

In that each of the four-bar linkages comprising the cross-members 20 and 22 are extensibly and retractably formable under the influence of a linear hydraulic actuator, narrowing, widening, canting, raising and lowering are all accomplished through manipulation of the articulations of the four-bar linkages, as described.

The capsized catamaran shown in FIG. 1 can be righted in two different ways which are referred to herein as "piecemeal righting" and "articulated righting". A multi-hull craft, such as a catamaran, may comprise what is referred to herein as a "simple" configuration meaning that the articulated cross-beam is hinged only at its center point and at its ends and may also comprise a deck structure hinged longitudinally about its midline and which, when the hinge is unlocked, allows the two hulls to rotate downward and inward toward one another. A multi-hull craft with a "complex" configuration includes fore and aft cross-beams that are hinged or articulated in more than one location allowing it to fold into a "M" or "W" shape configuration.

Piecemeal Righting.

Figure 9A:
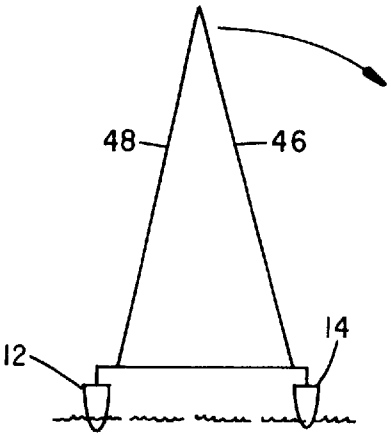
FIGS. 9A through 9D schematically illustrate the steps involved in piecemeal self-righting of a catamaran having a simple articulated configuration.
Figure 9B:
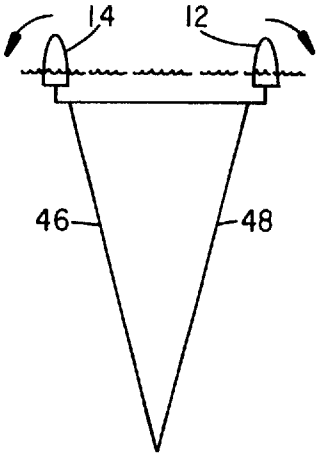
Figure 9C:
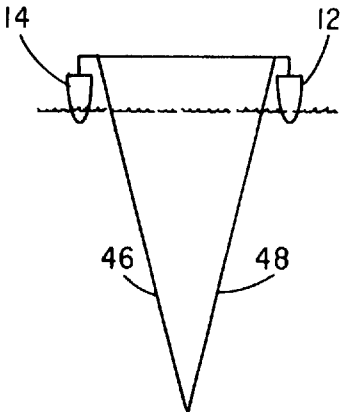
Figure 9D:
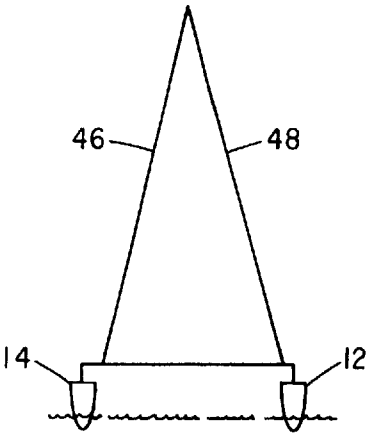
Figure 10A:
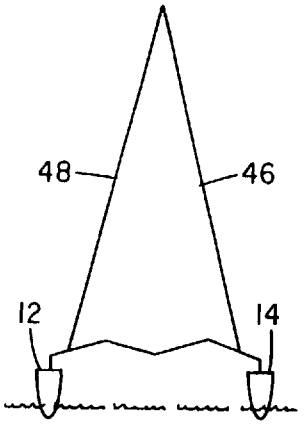
FIGS. 10A through 10D schematically illustrate the steps involved in piecemeal righting of a catamaran having a complex configuration.
Figure 10B:
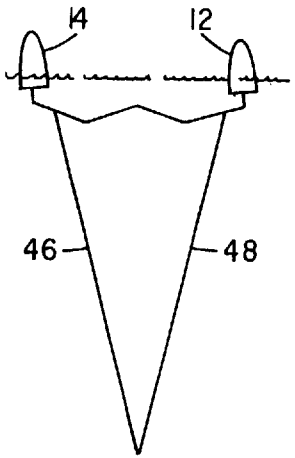
Figure 10C:
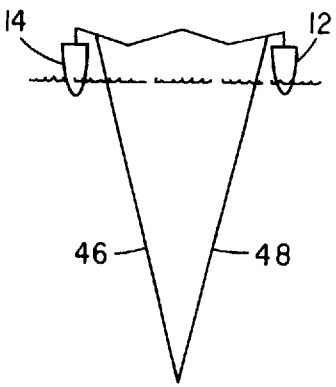
Figure 10D:
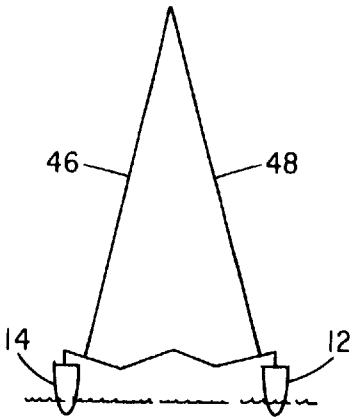
Figure 11D:
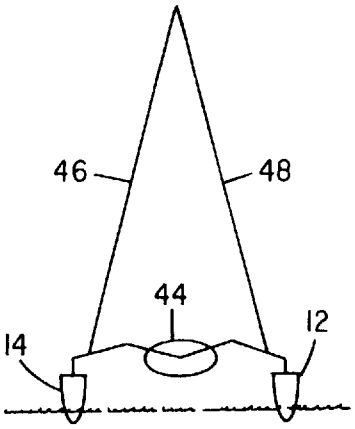
FIGS. 11A through 11D schematically show the steps involved in piecemeal self-righting of a catamaran of a complex configuration and incorporating a centerpod or cabin.
Figure 11C:
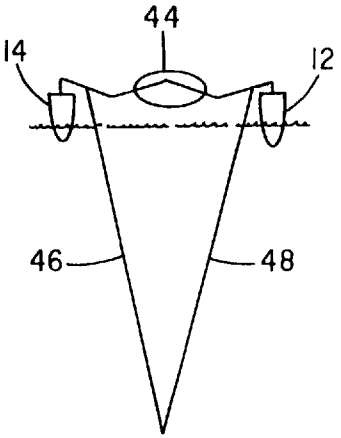
Figure 11B:
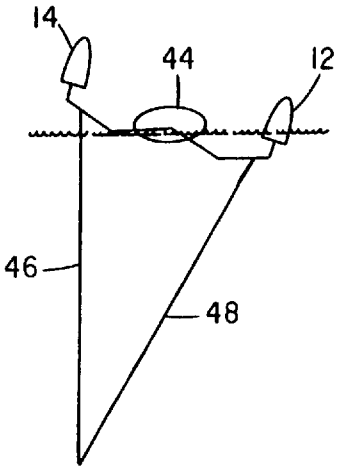
Figure 11A:
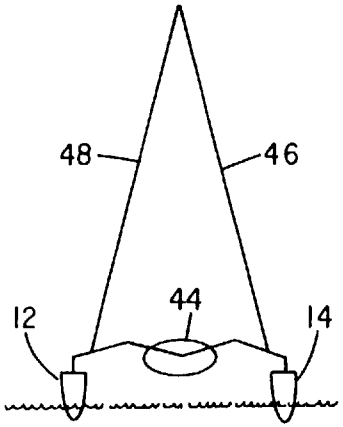

The schematic drawings of FIGS. 9A through 9D aid in visualizing the sequence of steps involved in piecemeal righting of a multi-hull sailing craft of the "simple" configuration. In FIG. 9A, a catamaran is shown as sailing normally and in FIG. 9B is shown as having capsized by rolling over. Piecemeal righting of the catamaran is accomplished by rotating the capsized, upward-pointing hulls 12 and 14 outward and downward about a line parallel to their fore-aft axes to a newly upright orientation. As such, what had formerly been the port hull is now on starboard and the formerly starboard hull is on port (see FIG. 9C). In effecting such rotation, fore and aft hinge pins as at 37 in FIGS. 4A–4C are removed from the fitting 32 closest to the hulls and either angular or rotational hydraulics (not shown) or lines as at 41 in FIG. 1 wrapped around the hulls and to winches can be used to provide the necessary rotational forces for inverting the hulls from the position shown in FIGS. 1 and 9B to a position where the center boards 16 and 18 are in the water beneath the hulls. The center cabin pod 44 has already rotated about its bearing joints during capsize. It next remains to pull the bipod mast structure from its submerged orientation illustrated in FIGS. 1 and 9C to an upright configuration shown in FIG. 9D. This is achieved by first loosening the backstays. In that the masts 46 and 48 are hollow and buoyant, once the aft stays are released, the mast is free to rotate about the fittings 52 and 54 mounted proximate the outer ends of the fore cross-beam 20 in the direction of the arrow 55 so as to be floating on the surface of the water and pointing forward of the vessel. When so disposed, the forestrut assembly, including the twin forestrut poles 60 and 62 and the Genaker pole 66, provide the final leverage needed for erecting the masts, either manually or with the aid of a winch, to the disposition shown in FIG. 9D. During piecemeal mast righting, only aft control needs to be applied in that the bipod mast structure is stable side-to-side and forward.

In the same way that the schematic drawings of FIGS. 9A–9D illustrate the steps in piecemeal righting of a catamaran in a simple configuration, FIGS. 10A through 10D illustrate the piecemeal righting of a catamaran having a complex configuration, i.e., cross-beams comprising more than two segments. FIGS. 11A through 11D illustrate piecemeal righting of a catamaran of a complex configuration and having a cabin or pod rotatably disposed on bearings between fore and aft cross-beams.

Figures 12A, 12B, 12C, 12D:
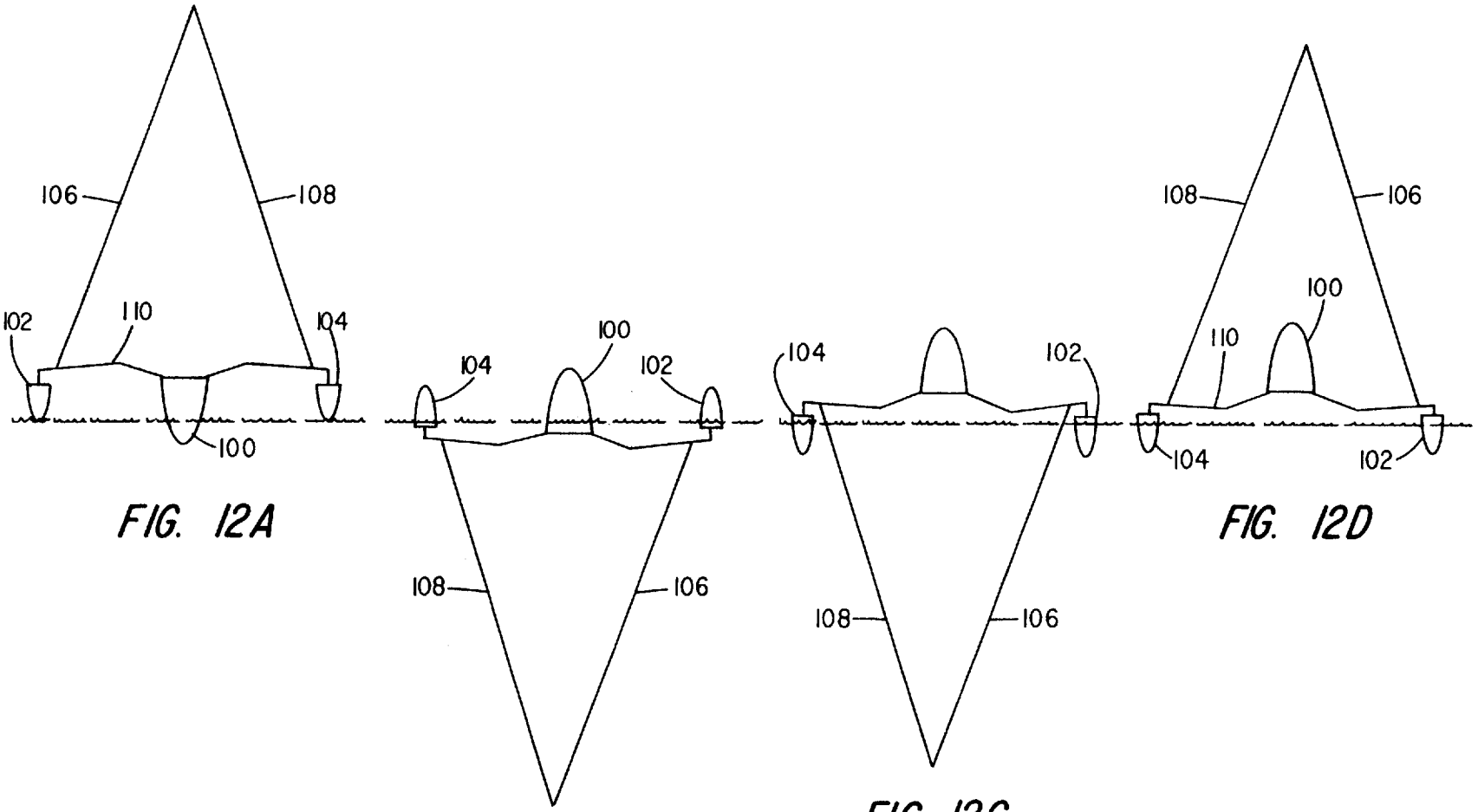
FIGS. 12A through 12D schematically show the steps involved in piecemeal self-righting of a trimaran having a complex configuration.

The schematic drawing of FIGS. 12A through 12D illustrate the steps involved in piecemeal righting of a capsized trimaran having a center hull 100 and port and starboard amas 102 and 104, respectively. The trimaran is shown as having a bipod mast including mast segments 106 and 108. In FIG. 12B, the craft is shown as having capsized by rolling over such that the bottoms of the hull and amas are directed upward. Piecemeal self-righting is again accomplished by first rotating the amas 102 and 104 outward and downward about pivots on the outer ends of the cross-beam members 110 followed by raising the mast by rotating it about the cross-beam 110. As shown in FIG. 12D, this leaves the hull 100 inverted, but nonetheless would permit the craft to be sailed to a place of safety.

Figure 13A:
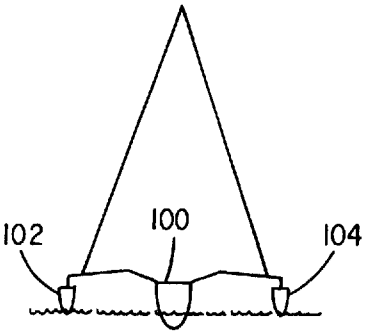
FIGS. 13A through 13D schematically show the steps involved in the piecemeal righting of a trimaran having a center hull bearing-supported between terminal cross-members.
Figure 13B:
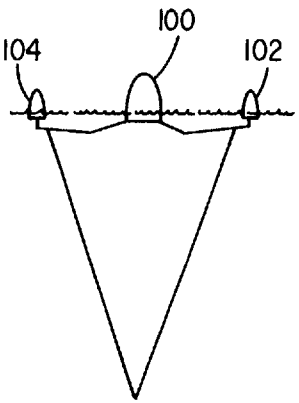
Figure 13C:
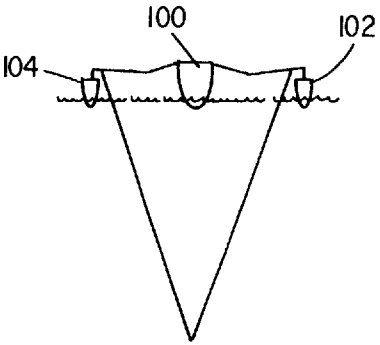
Figure 13D:
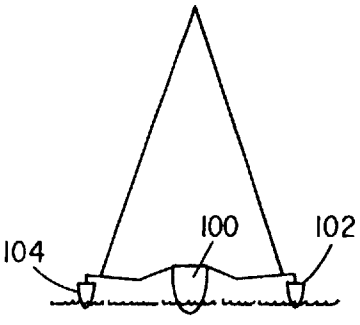

FIGS. 13A through 13D are similar to those of FIGS. 12A through 12D except that the center hull 100 of the catamaran shown in FIGS. 13A through 13D is pivotally suspended between terminal fore and aft cross-beams and thereby allowing the center hull 100 to be rotated along with the outboard amas as shown in FIG. 13C.

Articulated Righting.

Figure 14:
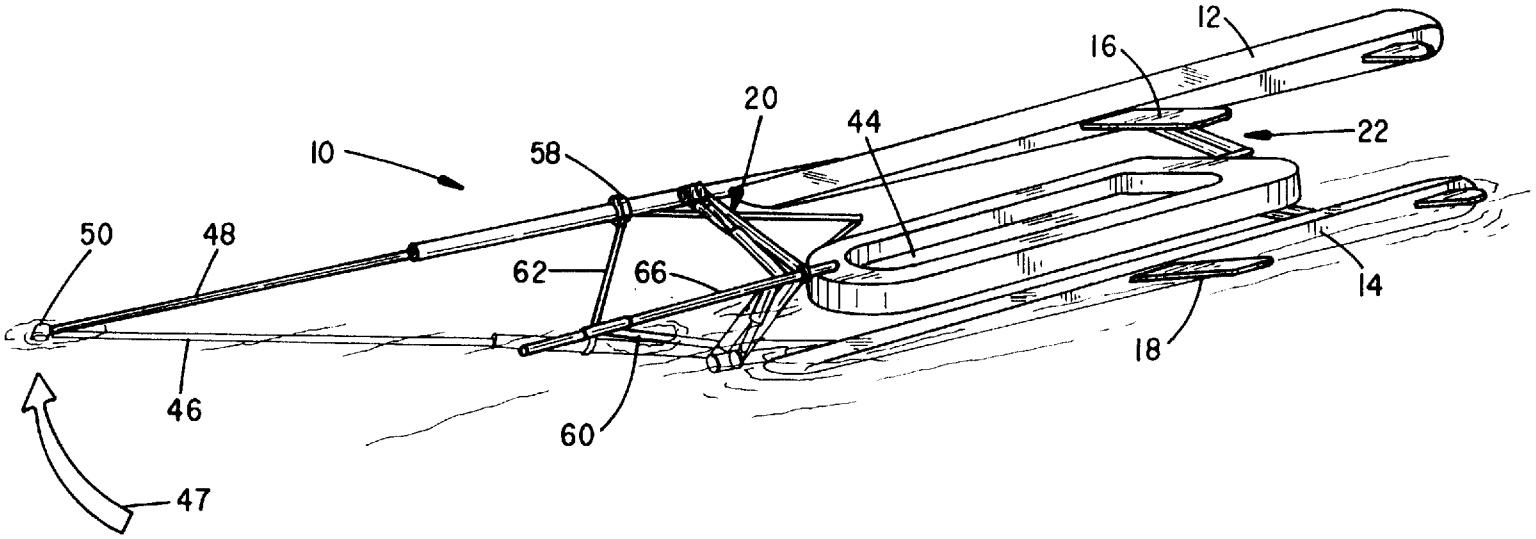
FIG. 14 is a view of a complex catamaran with a center pod like that of FIG. 1 being righted using the articulated approach.

Articulated righting of a capsized catamaran is achieved by a sequence of maneuvers which will be described with the further aid of the prospective views of FIGS. 14–16 and the schematics of FIGS. 17 through 21.

Starting with the vessel in the capsized orientation shown in FIG. 1, the first step in the articulated righting maneuver is to narrow the beam of the craft by actuating the hydraulic cylinders of the articulated cross-beams 20 and 22. Now, the capsized catamaran, which is already resting on the cabin or centerpod 44 and on one hull 14 tends toward even greater imbalance. (See FIGS. 14 and 17C.) Moreover, the hollow, buoyant bipod mast member 46 will also contribute to the rotational moment as it rises up in the direction of the arrow 47 and the catamaran will come to rest with the lower mast 46 lying near the surface of the water. (See FIGS. 14 and 17D.) This force vector or rotational moment is enhanced in that the entire length of the mast extension 46 lies on the surface of the water and contributes to flotation, compared with what would be the case if only a tip of a single mast were involved. In the narrowed configuration shown in FIG. 14, and following the rotation afforded by the flotation of the mast 46, the pod 44 will be suspended up and out of the water with all weight being born by the mast and the lower hull 14.

Figure 15:
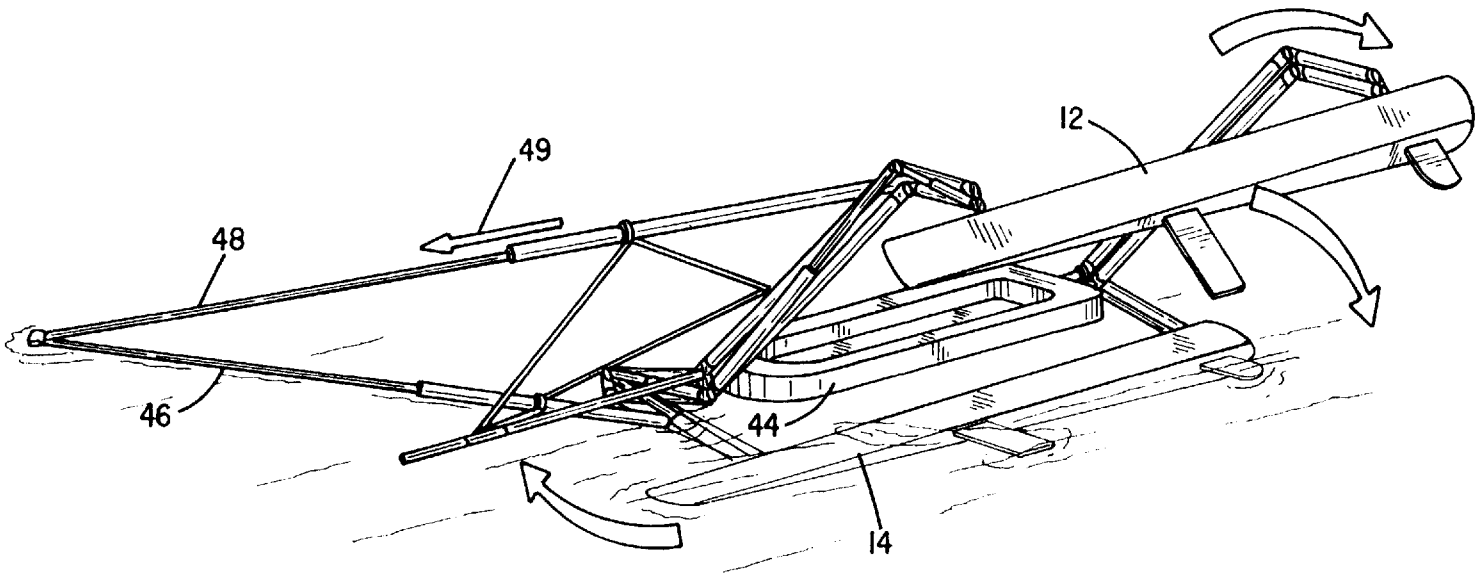
FIG. 15 is a view of the catamaran of FIG. 14 at a later stage of being righted using the articulated approach.
Figures 17A, 17B, 17C, 17D, 17E, 17F, 17G, 17H:
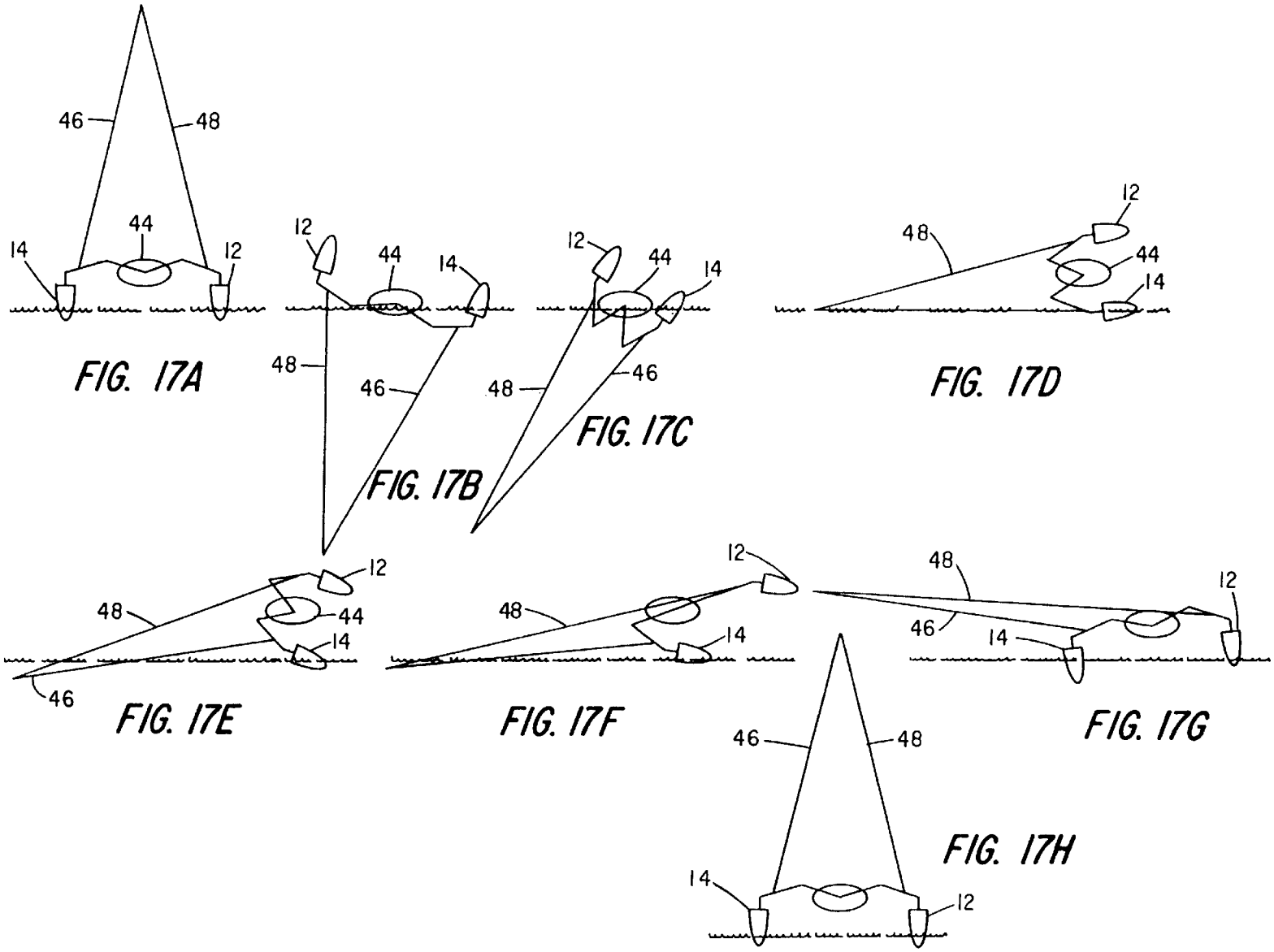
FIGS. 17A through 17H are schematic drawings showing the steps in the method of self-righting a catamaran of a complex configuration equipped with a center pod or cabin and using the articulated approach.
Figures 19A, 19B, 19C, 19D, 19E, 19F, 19G:
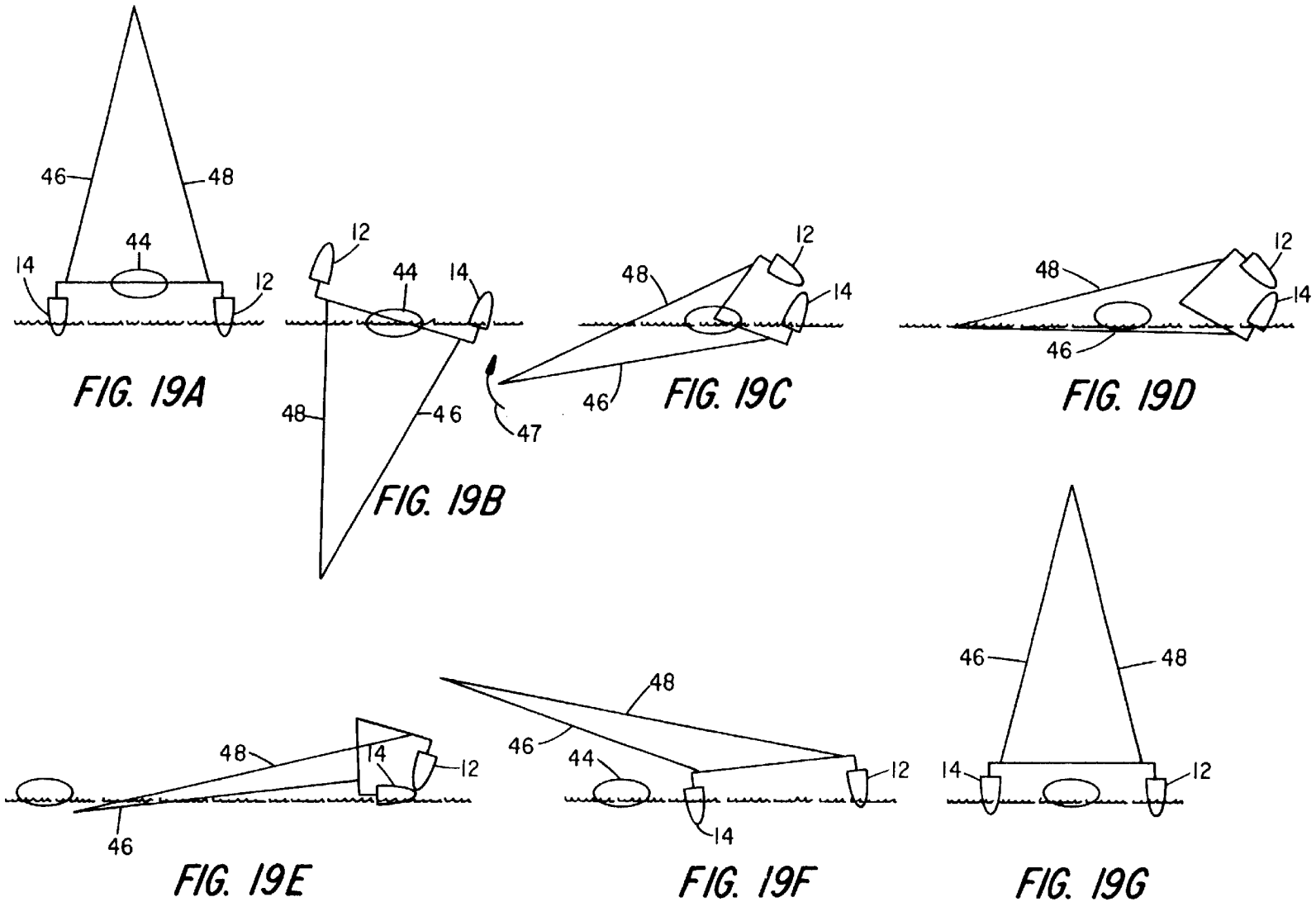
FIGS. 19A through 19G are schematic drawings showing the method of self-righting a capsized catamaran having a center pod or cabin and a simple configuration using the articulated approach.
Figure 20A:
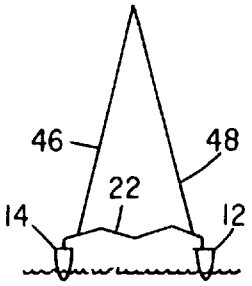
FIGS. 20A through 20H are schematic drawings showing the method of self-righting of a capsized catamaran of a complex configuration using the articulated approach.
Figure 20B:
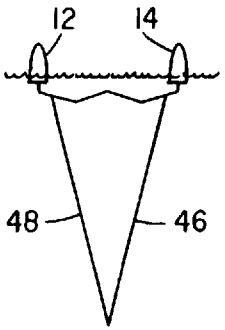
Figure 20C:
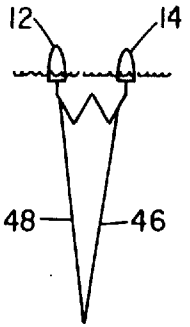
Figure 20D:
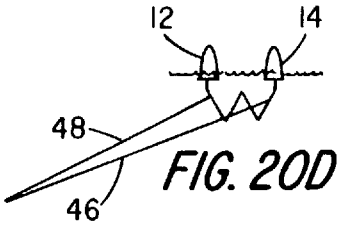
Figure 20E:
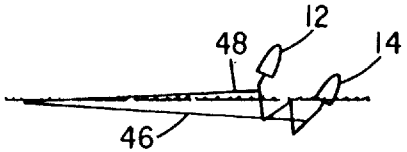
Figure 20F:
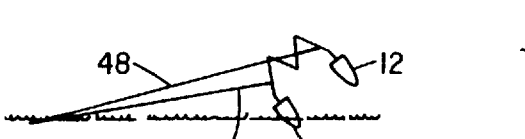
Figure 20G:
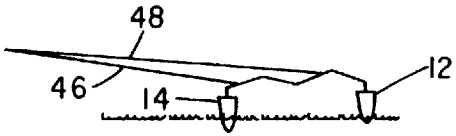
Figure 20H:
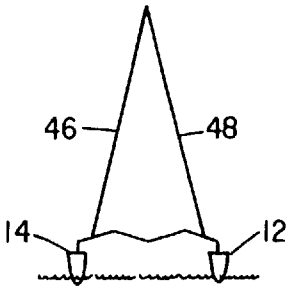
Figures 21A, 21B, 21C, 21D, 21E, 21F, 21G, 21H, 21I:
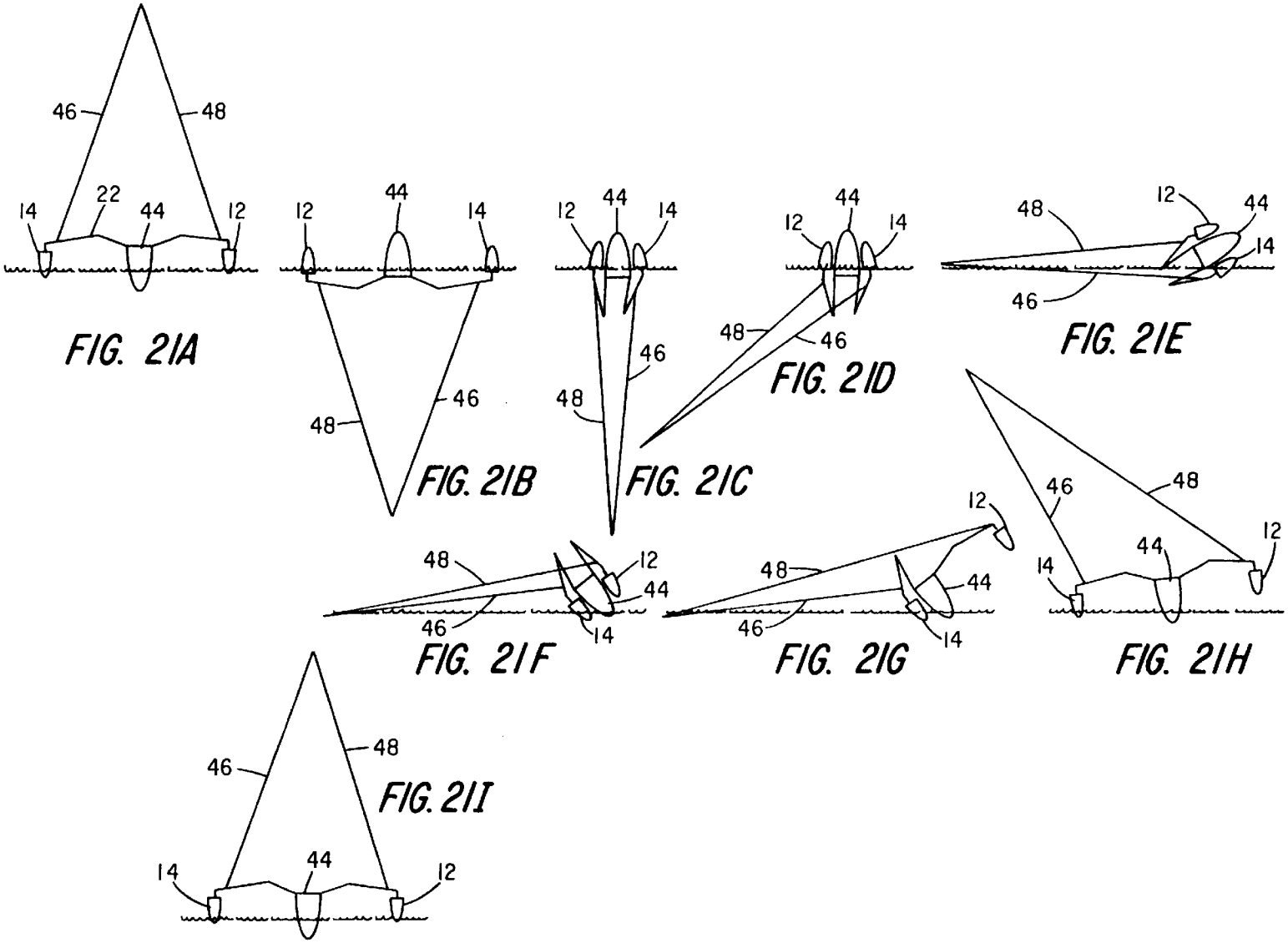
FIGS. 21A through 21I are schematic drawings showing the steps in the method of self-righting a trimaran of the complex configuration using the articulated approach.

At this point, and with reference to FIG. 15, the now only half-capsized, already narrowed, catamaran 10 can have the length of its upper telescoping bipod mast 48 along with the upper fore and aft side stays individually extended, as indicated by the arrow 49, in order to permit the elevated hull 12 to rotate further toward the upright, while the lower mast segment 46 remains floating parallel to the surface of the water (FIGS. 15 and 17E). Now, by extending the previously retracted articulations of the upper cross-member segments 20*a*, 20*b*, 22*a* and 22*b*, along with further extending the upper mast, the righting lever arm of the catamaran will likewise increase to as much as one-half of the original beam of the catamaran. This may be sufficient to cause complete rotation clear over onto the extended upper hull 12 and the still retracted lower hull 14 (FIG. 17F).

Figure 16:
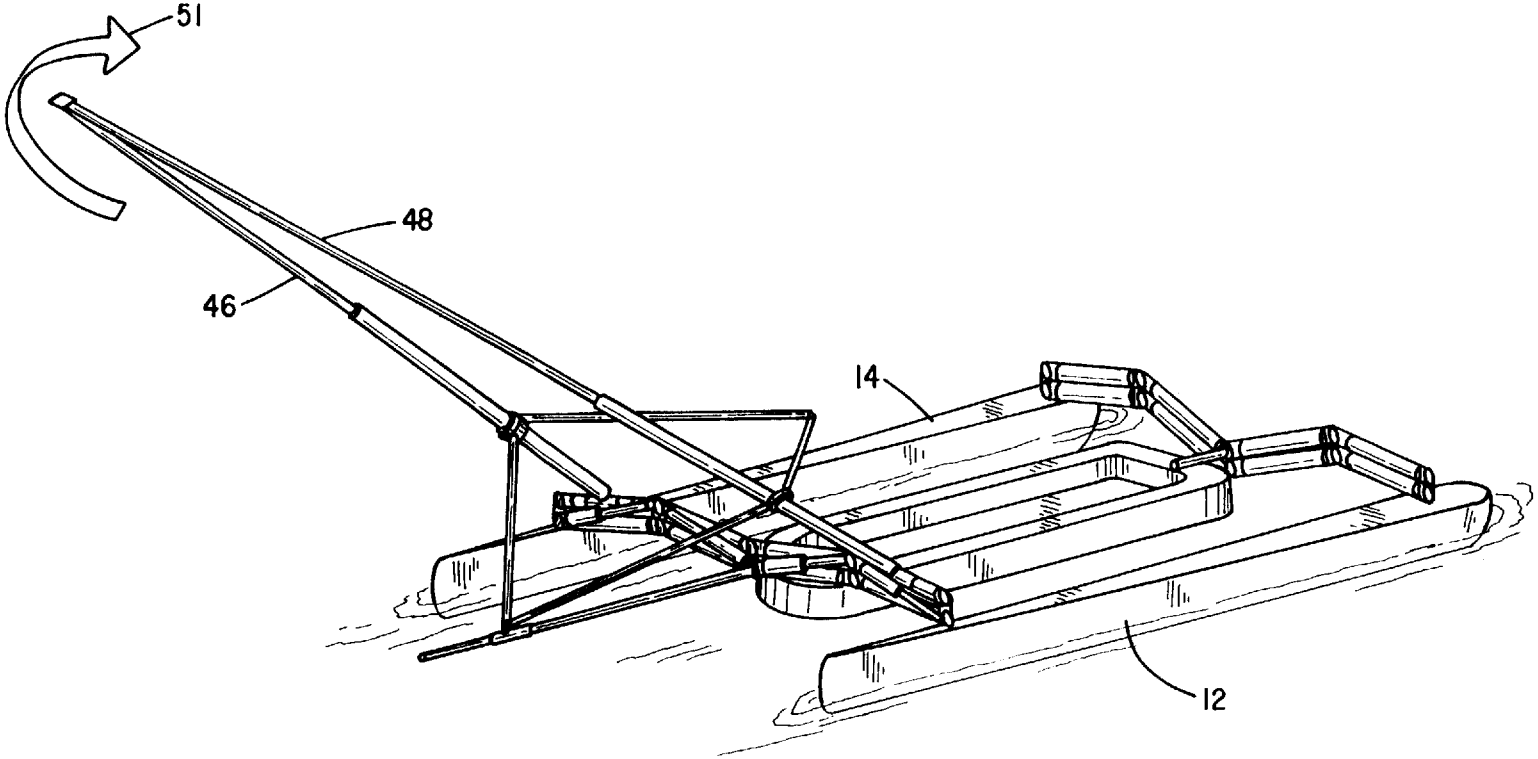
FIG. 16 is a view of the catamaran of FIG. 15 in a final stage of the being righted using the articulated approach.

Next, as shown in FIGS. 16 and 17G, the retracted lower segments of the cross-member associated with the hull 14 are extended to thereby arrive at a righting lever arm equal to the total original beam of the catamaran, a moment which, given the weight of the extended hull 12, the pod or cabin 44 and the crossbeam, is sufficient to overcome the opposing weight of the bipod mast, which, as earlier mentioned, may typically be 1 to 2 times the length of the beam.

With continued reference to FIG. 16, with both of the catamaran hulls and cross-members in the normal upright position to thereby provide a stable platform, the extended side of the telescoping bipod mast is next mechanically shortened to its normal length, identical to the other mast half, bringing the bipod mast to its fully erect position as indicated by the arrow 51 in FIG. 16. The rigging can again be rendered taut, using the conventional winches. Moreover, to facilitate tensioning of the stays and other rigging and to induce stiffness and rigidity to the vessel, it is possible to mechanically extend the bipod mast when in the upright position.

The schematic drawings of FIGS. 18A through 18H illustrate articulated righting of a catamaran without a buoyant centerpod and of a simple configuration. Shown schematically in FIGS. 18A–18H is a catamaran comprising a deck or platform indicated generally by numeral 23 in FIG. 18A having first and second platform halves 25A and 25B joined by at least one hinge 27, allowing folding of the cross-beam or deck only at its midpoint. Lacking a buoyant center pod to obtain an initial deviation of the mast structure from the vertical so that the buoyant mast can aid in rotating the craft from fully to partially capsized, canting of the mast by lengthening one leg 46 in FIG. 18D may be required in this and a number of other configurations. Having already described the manner in which articulated righting is achieved, no other explanation is deemed necessary in understanding the sequence of steps illustrated by FIGS. 18A through 18H. In a similar fashion, FIGS. 19A through 19G illustrate the steps in self-righting of a catamaran of a simple configuration, but including a cabin pod 44 that can be released from the cross-members and then reattached following the righting thereof in order to avoid having to elevate it over a great and unstable arc.

The schematic drawings of FIGS. 20A through 20H illustrate the sequence of steps in the articulated righting of a capsized complex catamaran that does not include a center pod or cabin.

FIGS. 21A through 21I are included to schematically illustrate the steps involved in the articulated self-righting of a capsized trimaran and, again, the drawings are believed to be self-explanatory, given the foregoing detailed description of the articulated self-righting maneuver.

In that all the articulations and extensions as well as the hydraulics or other mechanisms employed to achieve same would be used daily for narrowing-widening, rig tensioning, etc., their operating condition is known and they can be expected to function properly in the event of a capsize.

While the invention has been described primarily in connection with the self-righting of a catamaran, trimaran and proa righting can be accomplished in a similar manner, both through piecemeal and articulated sequences.

Figure 22:
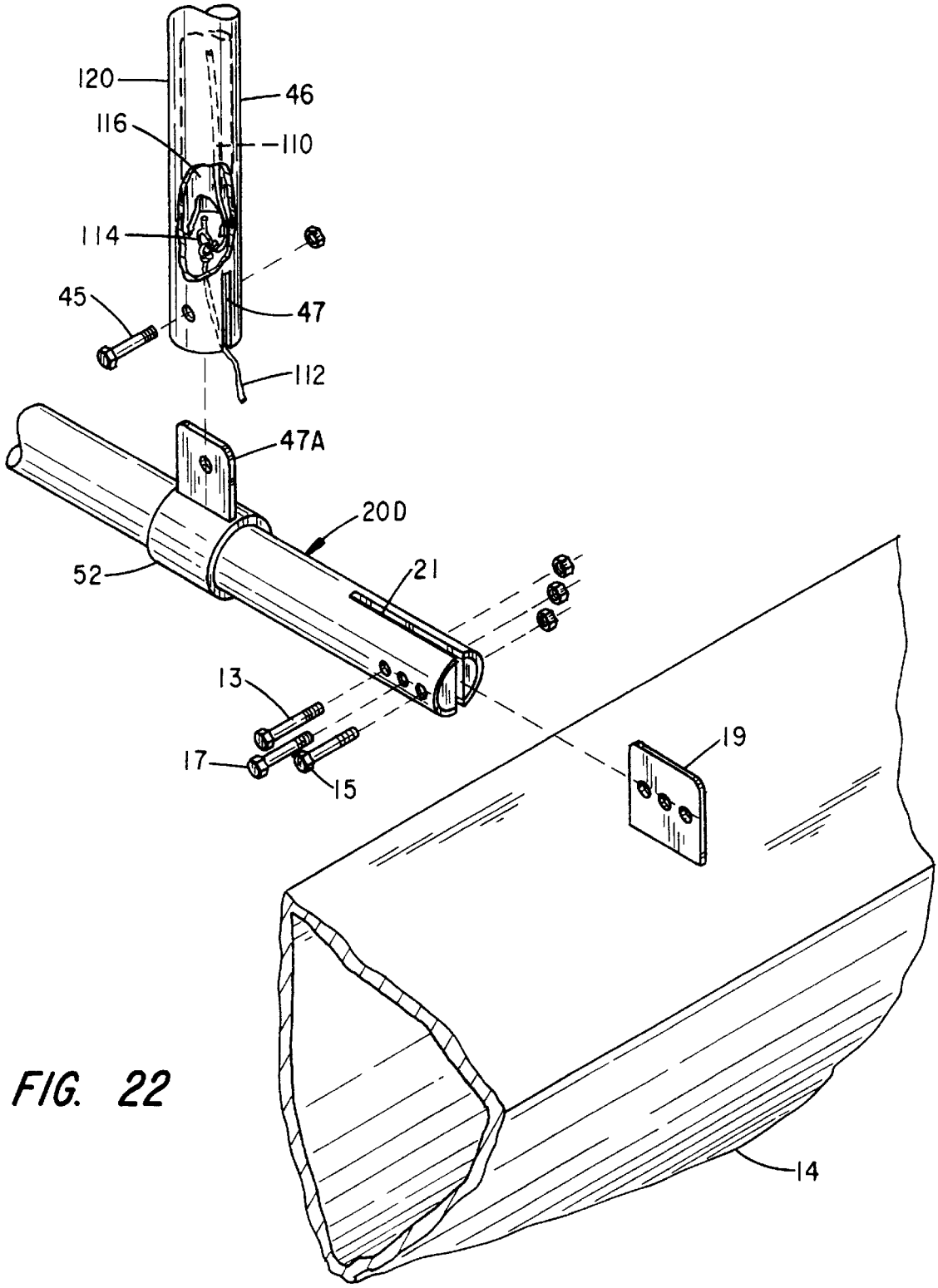
FIG. 22 is an exploded view showing the connection of a hull member of a multi-hull craft to an end of a simple cross-beam and of a mast segment to the cross-beam.

FIG. 22 is an exploded partial view of a catamaran hull 14 along with the end portion 20*d* of a simple cross-beam carrying a rotatable fitting 52 to which the lower portion of the telescoping bipod mast segment 46 is attached. From this drawing, it can be readily appreciated how the hull 14 can be inverted during the piecemeal righting of the capsized craft. By merely removing the two endmost bolts 13 and 15 while leaving the center bolt 17 only loosened, the hull 14 can be rotated 180° with the apertured plate 19 that is affixed to the hull 14 residing in the elongated slot 21 of the cross-beam end 20d. Reinserting the fasteners 13 and 15 secures the hull in a newly upright disposition.

The mast 46 may also have a slot 47 in the lower end thereof for receiving a plate 47A that is welded or otherwise affixed to the ferrule 52. A bolt or other suitable fastener as at 45 will function to secure the mast to the ferrule and permit rotation of the mast about the cross-beam member 20*d*. The reader will by now appreciate that the rotatable coupling 52 with possible modifications for the complex configuration will allow the mast to be rotated up and out of the water to its desired erect position following the piecemeal righting of the catamaran hulls as well as permitting narrowing and widening of the overall beam.

Figure 24:
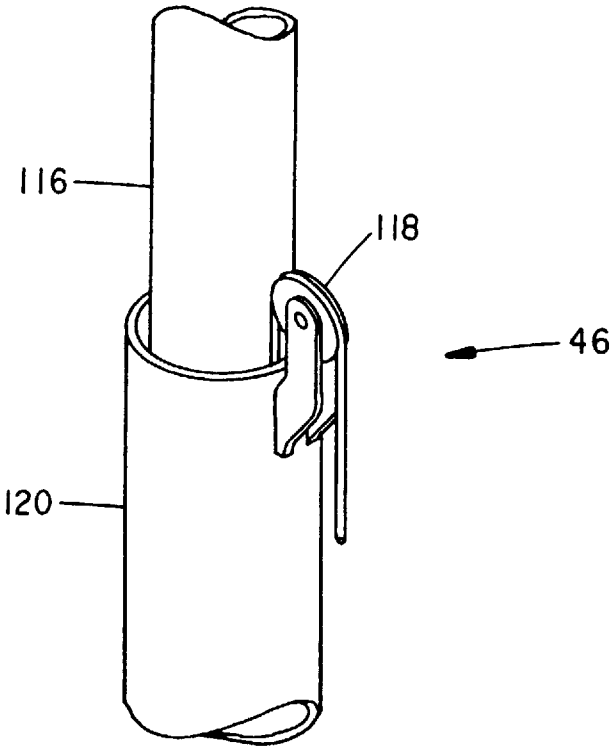
FIGS. 23 and 24 illustrate a mechanism for extending and retracting telescoping mast segments during articulated righting of a multi-hull craft.
Figure 23:
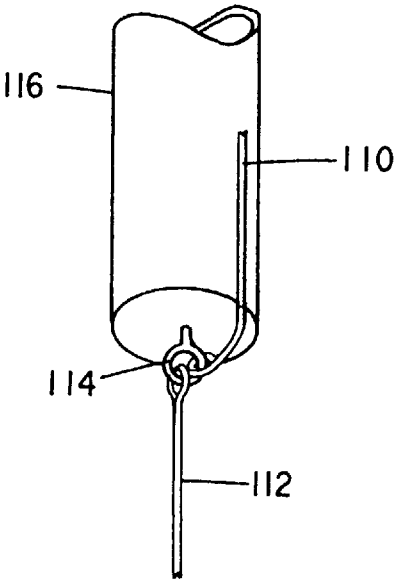

FIG. 23 is a perspective view of the lower end portion of the inner telescoping mast member and it is seen to include first and second cables 110 and 112 affixed to an eyebolt 114 secured to the lower end of the mast segment 116. Referring next to FIG. 24, the first cables 110 is routed upward through the outermost tubular segment of the telescoping mast and deployed about a pulley 118 and then down the outside of the mast to an attachment point on an associated hull. Using a winch or other suitable device, the cable can be tensioned, causing the inner segment 116 of the telescoping mast to be extended out from the center of the outer tubular mast segment 120. The second cable 112 shown in FIG. 23 extends down through the center of the outer tubular segment 120 and, as shown in FIG. 22, can be tensioned to retract the inner tubular mast segment 116 back into the outer tubular mast segment 120 to thereby shorten the effective length of the mast as is required during articulated righting of a multi-hull craft.

It is contemplated that the mechanical and/or hydraulic devices utilized to extend and retract the cross-members 20 and 22 and to lengthen and shorten the individual mast halves 46 and 48 can be under control of a microprocessor-based controller for a hydraulic motor/pump combination and, hence, the righting sequence described herein can be readily automated.

Where the multi-hull craft includes a single mast rather than a bipod mast, reerecting the mast during piecemeal righting of the craft is somewhat simplified. With reference to FIG. 25, which is a schematic drawing of a single masted catamaran in a capsized condition, following the piecemeal righting of the hulls in the manner already described, the mast shown submerged vertically in the water can be reerected by simply jacking it up vertically through the deck as indicated by the arrowhead 122 or it can be swung up between the bows as described previously. Similarly, when applied to a trimaran, as shown in FIG. 26, the mast can be jacked vertically through a tubular passageway 124 formed through the center hull thereof as indicated schematically in FIG. 26.

FIG. 27 shows schematically how a single mast 126 can be canted to one side or the other as indicated by arrows 128 and 130 to cause the craft to rotate in one direction or the other upon the narrowing of the crossbeam. By loosening one of the stays 132 or 134 and tightening the other, the mast will be tipped from its centered disposition and because of its buoyancy, then tend to float upward, adding to the rotational moment of one narrowly configured hull above and over the other during the articulated righting sequence. The stays tension is then manipulated to reverse the direction of the canting of the mast. Once the hulls have been righted, the single mast 126 can then be centered by adjusting the stays 132 and 134.

The same technique explained with the aid of FIG. 27 can be used to assist in the articulated righting of a trimaran illustrated in FIG. 28. That is to say, after shortening of the cross-beams to draw the amas close to above the center hull, the tension of the stays 136 and 138 may be manipulated to cant the mast to one side such that the buoyancy of the mast will provide a requisite initial turning moment to rotate the craft to the point where it is floating on its side. The stays tension is then manipulated to reverse the direction of the centering of the mast. Now, extension of one-half of the complex articulated cross-beam and then the other will deploy the hull attached to it to the point where its weight is capable of elevating the mast out of the water and completing the inversion.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A self-righting, multi-hull watercraft, comprising:

(a) first and second elongated hull members each having a fore and an aft axis;

(b) a first cross-member comprising a plurality of parallelogram linkages pivotally coupled to one another in an end-to-end relationship extending between the first and second hull members for providing adjustable parallel spacing between said hull members; and (c) pivot means for securing the first and second hull members to opposed ends of the first cross-member such that the first and second hull members are adapted to be individually rotated about an axis parallel to the fore and aft axes through an angle of at least 180 degrees.

2. The self-righting, multi-hull watercraft as in claim 1 and further including actuator means coupled to said parallelogram linkages for extending and retracting the first cross-member.

3. The self-righting, multi-hull watercraft as in claim 2 wherein the actuator means is selected from a group consisting of manual, electrical, hydraulic and mechanical.

4. The self-righting, multi-hull watercraft as in claim 1 and further including a first mast affixed to and extending upward from the first cross member.

5. The self-righting, multi-hull watercraft as in claim 1 and further including first and second masts, the masts being coupled together at a first end, and second ends of the first and second masts being secured to the first cross-member proximate the pivot means.

6. The self-righting, multi-hull watercraft as in claim 5 wherein the-first and second masts are secured to the first cross-member with a rotatable coupler.

7. The self-righting, multi-hull watercraft of claim 6 and further including a second articulated cross-member extending parallel to the first cross-member between the first and second hull members.

8. The self-righting, multi-hill watercraft as in claim 7 and further including:

(a) an elongated rigid Genaker pole affixed to the first cross-member approximately at a midpoint thereof and projecting forwardly therefrom;

(b) first and second forestruts each coupled at one end to a jib tack fitting on the Genaker pole and at an opposite end to the first and second masts;

(c) a jibstay extending from the first ends of the first and second masts to the jib tack fitting; and (d) first and second guywires connected between the jib tack fitting and the first and second masts approximate a point where the first and second masts are secured to the first cross-member.

9. The self-righting, multi-hull watercraft as in claim 8 and further including:

(a) an elongated rigid main tack support pole affixed to the first cross-member approximately at a midpoint thereof and projecting rearwardly thereof;

(b) first and second aft struts each coupled at one end to a main tack fitting on the main tack support pole and at an opposite end to the first and second masts;

(c) a mainsail luff line extending from the first ends of the first and second masts to the main tack fitting;

(d) third and fourth guywires connected between the main tack fitting and the first and second masts, proximate the point where the first and second masts are secured to the first cross-member; and (e) cross wires affixed at opposite ends to the first and second masts at the level where the fore struts and the aft struts are affixed.

10. The self-righting, multi-hull watercraft as in claim 7 and further including a cabin pod pivotably suspended from and extending between the first and second cross-members at a midpoint thereof.

11. The self-righting, multi-hull watercraft as in claim 10 wherein the cabin pod is bearing mounted between the first and second cross-members.

12. The self-righting, multi-hull watercraft as in any one of claims 1 and 2 through 11 and further including means for rotating the first and second hulls about an axis that is parallel to the fore/aft axis of the first and second hulls.

13. The self-righting, multi-hull watercraft of claim 12 wherein the means for rotating the first and second hulls comprise an elongated flexible rope or cable wrapped about one of the first and second hulls and coupled to a device for tensioning the rope or cable.

14. The self-righting, multi-hull watercraft of claim 5 wherein the first and second masts are buoyant.

15. A multi-hull watercraft comprising:

(a) first and second elongated hulls each having a longitudinal axis;

(b) means for holding the first and second hulls in parallel, spaced-apart orientation including first and second articulated cross-beams, each cross-beam including a plurality of linkages connected end-to-end by plate members, each linkage being a parallelogram structure: and actuator means coupled between the plate members and the parallelogram structures for selective elongation and contraction of the first and second cross-beams;

(c) hinge means on the means for holding for permitting the parallelogram structures to fold to reduce the spacing between the first and second hulls; and (d) an extendable and retractable buoyant mast affixed to and normally projecting upwardly from the means for holding when the first and second hulls are floating upright.

16. The multi-hull watercraft of claim 15 wherein the mast comprises a first tubular member having inner and outer telescoping tubular segments with means for displacing the inner segment relative to the outer segment.

17. The multi-hull watercraft of claim 16 wherein the mast further includes a second tubular member having inner and outer telescoping tubular segments with means for displacing the inner segment relative to the outer segment and with one end of the inner segment of the first tubular member hinged to one end of the inner segment of the second tubular member.

18. The multi-hull watercraft of claim 17 wherein the means for displacing the inner segments of the first and second tubular members comprises a cable connected to a base of the inner tubular segments of the first and second tubular members and about pulleys affixed to a first end of the outer tubular segments of the first and second tubular members, a second end of the outer tubular segment of the first and second tubular members being coupled to the means for holding the first and second hulls in parallel, spaced-apart orientation.

19. A method of righting a capsized, multi-hull watercraft of the type having first and second hull members held in parallel, spaced-apart relation by fore and aft articulated cross-members, means for extending and retracting the length of the articulated fore and aft cross-members, and a buoyant bipod mast having first and second mast segments joined together at one end thereof and coupled to the fore and aft cross-members proximate the first and second hull members, each of the first and second mast segments including telescoping members; and means for extending and retracting the telescoping mast members relative to one another, comprising the steps of:

(a) retracting the length of the articulated fore and aft cross-members to narrow the beam of the watercraft;

(b) allowing the buoyant mast to float to the surface of the water and thereby elevate one of the first and second hulls out of the water;

(c) extending the telescoping mast members of an uppermost one of the first and second mast segments to displace the one of the first and second hulls beyond a centerline of the other of the first and second hulls;

(d) extending the length of the articulated fore and aft cross-members so that the rotational moment of the one of the first and second hulls about the other is increased; and (e) retracting the telescoping mast members of the mast segment that had been extended in step (c).

20. The method of claim 19 and further including the step of canting the buoyant bipod mast to one side of vertical following step (a).

21. A self-righting, multi-hull watercraft comprising:

(a) first and second elongated hull members;

(b) fore and aft articulated cross-members extending between the first and second hull members, each including a plurality of parallelogram segments hinged together in end-to-end relation, and means coupled between adjacent segments for extending and retracting the effective length of the cross-members, for adjusting the beam of the watercraft;

(c) a buoyant bipod mast affixed to and supported by one of the fore and aft cross-members, the bipod mast including upper and lower telescoping segments, whereby each half of the bipod mast is extendable and retractable in length; and (d) a Genaker pole having one end secured to the fore cross-member approximately at a mid-point thereof and a pair of forestruts extending between a jib tack fitting slidable on the Genaker pole and the bipod mast.

22. The multi-hull watercraft of claim 21 wherein the watercraft is a catamaran.

23. The multi-hull watercraft of claim 21 and further including a plurality of stays extending between upper ends of the telescoping mast segments and said first and second hulls or said fore and after cross-members.

* * * * *